United States Patent [19]

Smith

[11] 4,319,939

[45] Mar. 16, 1982

[54] METHOD FOR MAKING CABLE HAVING A BUILT-IN CABLE SHIELD BONDING SYSTEM

[75] Inventor: Arnold R. Smith, Chester, N.J.

[73] Assignee: Bell Telephone Laboratories, Incorporated, Murray Hill, N.J.

[21] Appl. No.: 197,901

[22] Filed: Oct. 17, 1980

Related U.S. Application Data

[62] Division of Ser. No. 53,798, Jul. 2, 1979, Pat. No. 4,260,851.

[51] Int. Cl.[3] ..... H01B 13/06; H01B 13/26

[52] U.S. Cl. ..... 156/56; 156/54; 156/203; 156/207; 156/215; 156/218; 156/257; 427/185; 427/284

[58] Field of Search ..... 427/185, 284; 156/52, 156/53, 56, 201, 203, 205, 212, 215, 217, 218, 257, 291, 207

[56] References Cited

U.S. PATENT DOCUMENTS

| | | | |
|---|---|---|---|
| Re. 28,468 | 7/1975 | Baumgartner et al. | 174/88 R |
| 956,186 | 4/1910 | Schroder | 174/71 R |
| 3,206,541 | 9/1965 | Jachimowicz | 156/54 |
| 3,313,666 | 4/1967 | Battersby et al. | 156/218 |
| 3,411,542 | 11/1968 | Walsh et al. | 156/218 |
| 3,439,111 | 4/1969 | Miracle | 174/107 |
| 3,509,269 | 4/1970 | Elliot | 156/53 |
| 3,576,939 | 5/1971 | Ziemek | 174/107 |
| 3,629,489 | 12/1971 | Jachimowicz | 174/107 |
| 3,646,972 | 3/1972 | Kuypers | 174/71 R X |
| 3,662,090 | 5/1972 | Grey | 174/107 |
| 3,711,633 | 1/1973 | Ghirardi | 174/71 R X |
| 3,757,269 | 9/1973 | Baumgartner et al. | 174/88 R |
| 3,790,697 | 2/1974 | Buckingham | 174/107 X |
| 3,794,750 | 2/1974 | Garshick | 174/107 X |
| 3,896,261 | 7/1975 | Cole | 174/107 X |
| 3,945,870 | 3/1976 | Johnson | 156/257 |
| 3,971,894 | 7/1976 | Faust et al. | 174/41 |
| 4,002,819 | 1/1977 | Woytiuk | 174/23 C |
| 4,035,211 | 7/1977 | Bill et al. | 156/54 |
| 4,157,452 | 6/1979 | Pignataro et al. | 174/107 X |

FOREIGN PATENT DOCUMENTS

| | | | |
|---|---|---|---|
| 875521 | 8/1961 | United Kingdom | 174/78 |

*Primary Examiner*—Jerome W. Massie
*Attorney, Agent, or Firm*—J. W. Fisher

[57] ABSTRACT

Disclosed is a method for making an electrical cable (10) which includes a plurality of insulated conductors (11) bound together in close proximity to one another to form a cablecore. A sheet of insulative material (13) surrounds this cable core and this assembly in turn is further surrounded with a conductive shield (14). An insulative sheath (16) surrounds the entire assembly. Integral with the conductive shield are means (15) for providing shield continuity when the insulative sheath and conductive shield are entered.

9 Claims, 4 Drawing Figures

METHOD FOR MAKING CABLE HAVING A BUILT-IN CABLE SHIELD BONDING SYSTEM

CROSS REFERENCE TO RELATED APPLICATION

This is a division of applicant's copending application Ser. No. 053,798, filed July 2, 1979, now U.S. Pat. No. 4,260,851.

BACKGROUND OF THE INVENTION

1. Technical Field of the Invention

This invention relates to electrical conductors with joint grounding means and, more particularly, to electrical multiple conductor cables having a built-in cable shield bonding system.

2. Description of the Prior Art

When a cable sheath opening is made for the purpose of installing a cable terminal or closure, the electrically conductive shield is cut away. To provide shield continuity in a cable system, each closure and cable terminal must have provision for through bonding the cable shield. The electrical conductivity of this bond should be equivalent to that of the cable shield.

Bonding hardware which is used to restore the shield continuity generally consists of a pair of clamps which are attached to the shield at each end of the opening. These clamps are electrically connected to each other by a metal bar or wire.

One example of the type of clamp that is employed for this purpose is disclosed in U.S. Pat. No. 3,757,269, issued in the name of R. G. Baumgartner et al on Sept. 4, 1973. (This patent was subsequently reissued and bears U.S. Pat. No. Re 28,468.) The Baumgartner et al patents relate to a cable shield connector for providing electrical shield continuity at splice points or terminals. This connector utilizes contoured plates between which the shield and plastic outer jacket of the cable section are clamped. The inner plate has an upstanding tang or tab on one end and an upwardly protrudig threaded stud spaced from the tab. The outer end of the inner plate is slipped beneath the shield and an outer plate is mounted on the stud over the exterior of the plastic jacket. As the plates are forced toward each other, the outer plate first contacts the tab and tends to pivot thereabout tightly clamping the shield and jacket between the ends of the plates. The inner plate can have an insulating layer on its underside to prevent shorting of the cable conductors to the cable shield if damage occurs to the conductor insulation.

An illustration of the use of this type of shield connector appears in U.S. Pat. No. 3,971,894, Issued in the name of C. W. Faust et al on July 27, 1976. Faust et al disclose apparatus for enclosing splices between two or more multiconductor cables. This apparatus includes a unitary support member which has affixed thereto cable ground shield bonding circuitry.

While the above-described Baumgartner et al shield connector, when used in the manner set forth in Faust et al, provides good ground shield continuity at the point of entry into the cable, it should be noted that the installation of the bonding hardware is a field operation. Consequently, the quality of the shield bond is craft dependent. In some cases the bonding job is either done incorrectly or not at all. This failure to effect a proper shield bond can lead to degradation in transmission performance.

An indication of the state of the art in cable design can be obtained from a review of U.S. Pat. No. 4,002,819 issued in the name of L. V. Woytiuk on Jan. 11, 1977 and U.S. Pat. No. 4,004,077 also issued in the name of L. V. Woytiuk on Jan. 18, 1977. The Woytiuk '819 patent discloses an electric cable having a multistranded core of insulated conductors and a jacket. A mixture which forms a blockage to the penetration of water at least partially fills the spaces between and around the conductors. Surrounding the conductors and the water blockage mixture is a core wrap. Between the core wrap and a metal sheath is a filler of water repellant calcium carbonate and high molecular weight resin mix. The jacket forms the outer layer of the cable adjacent the metal sheath.

The Woytiuk '077 patent discloses a very similar cable to that described above. The major differences are the compositions of the water blockage mixture and the filler between the core wrap and metal sheath.

In should be apparent that none of the aforementioned references deals with the problem of providing an electrically conductive ground shield which is capable of remaining intact along a portion of its periphery when the insulative cable sheath or jacket and the metal sheath or shield are entered to gain access to the inner conductors.

SUMMARY OF THE INVENTION

The problems associated with cable design, the effectiveness of ground shield bonding circuitry, and its dependence upon proper installation by craft personnel are overcome in a accordance with the subject invention. This invention comprises an electical cable which includes a plurality of insulated conductors and means for binding the conductors in close proximity to one another to form a cable core. Insulative means surround this cable core. Surrounding the insulative means are conductive shield means. Insulative sheath means further surround the conductive shield means. Integral with the conductive shield means are means for providing shield continuity when the insulative sheath means and the conductive shield means are entered.

One of the advantages of this type of cable construction is that it ensures the integrity of the shield following entry into the cable without the need for separate ground bonding circuitry which circuitry might be improperly installed by a craftsperson or not installed at all due to oversight. Moreover, since connectors are not required, the possibility for high impedances to be encountered in the shield circuit is nonexistent.

Another advantage is that the shield continuity providing means comprises a folded edge of electrically conductive sheet material. This folded edge is formed of at least one fold of the conductive sheet material and it has a generally flattened S-like configuration. Encasing this folded edge are means for electrically insulating it from any exposed conductors in the plurality of conductors making up the cable core.

An even further advantage of this cable construction is that linearly extending along the folded edge are means for facilitating the removal of a section of the conductive shield means at a point of entry to the cable core while maintaining electrical continuity of the conductive shield means through the folded edge.

BRIEF DESCRIPTION OF THE DRAWINGS

The aforementioned advantages of my invention as well as other advantages will be better understood upon a consideration of the following detailed description and the appended claims taken in conjunction with the attached drawings of an illustrative embodiment in which:

DETAILED DESCRIPTION

Figure 1:
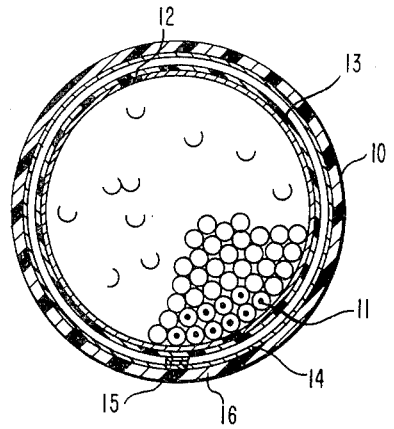
FIG. 1 is an end view of a cable manufactured in accordance with the present invention.

An end view of a cable 10 embodying the subject invention is illustrated in FIG. 1. In accordance with the illustrated embodiment, a plurality of insulated conductors 11 are bound together by a relatively narrow insulative tape 12 to form a cable core. Surrounding this cable core is an insulative layer 13. Juxtaposed insulative layer 13 is conductive shield 14 having folded edge 15 extending linearly along the length of cable 10. This entire assembling is covered with insulative sheath 16.

Figure 2:
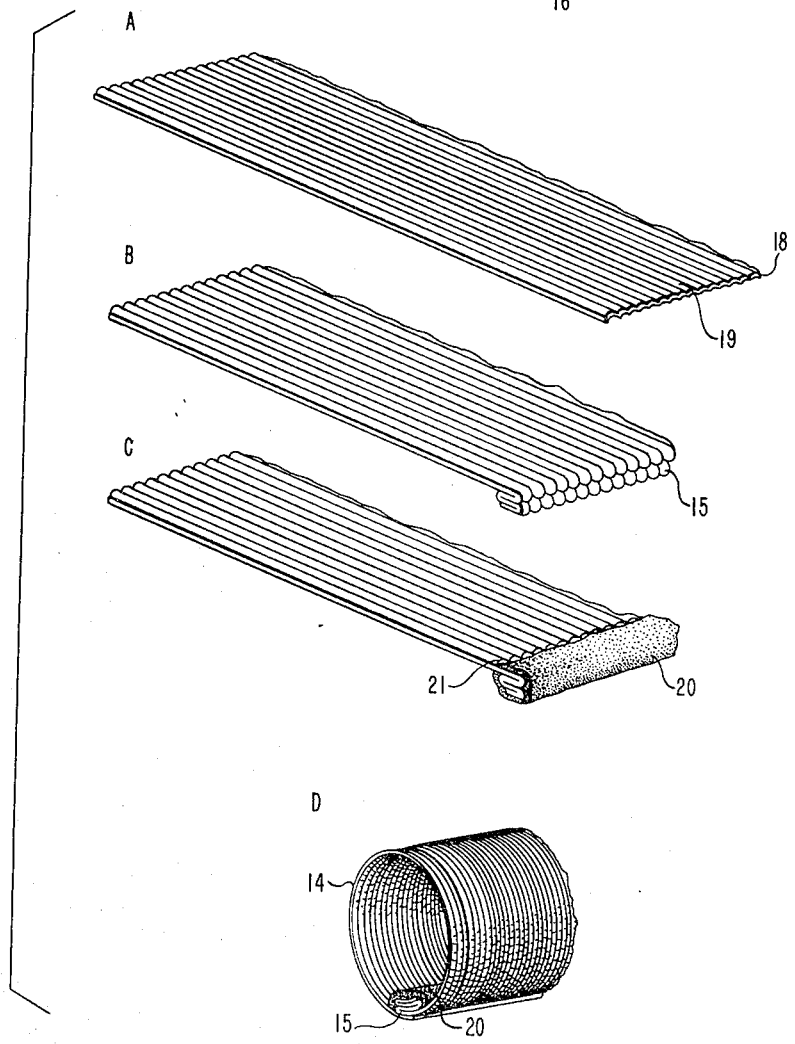
FIG. 2 illustrates the formation of the folded edge on the conductive cable shield to provide a built-in cable ground shield bonding system.

To fabricate the conductive shield 14, as shown in FIG. 2, a sheet 18 of electrically conductive material, such as aluminum, is fed through corrugating rolls (not shown) thereby forming corrugations 19 in sheet 18. One edge of sheet 18 is then folded to form at least one fold 15 having a generally flattened S-like configuration. Edge 15 can also be formed advantageously from a series of concentric rolls in sheet 18. Edge fold 15 provides a conductive path equivalent to the shield conductivity.

After edge fold 15 is formed, it is run through a fluidizing bed (not shown) to form insulative layer 20. Insulative layer 20 prevents any exposed conductors 11 in the cable core from coming into direct electrical contact with conductive shield 14. Adjacent insulative layer 20 on edge fold 15 there is provided either perforations or a scored line 21. Scored line 21 extends throughout the linear extent of cable 10. The final step is to form sheet 18 around the cable core.

Figure 3:
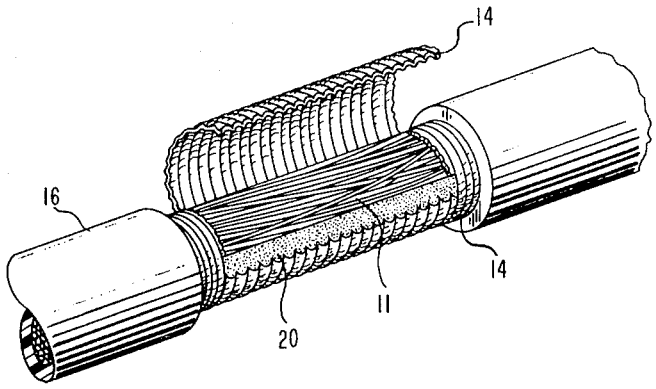
FIG. 3 illustrates the removal of a portion of the conductive shield while maintaining the integrity of the folded edge at a point of entry into the cable core.

When access is to be gained to the cable core, a section of insulative sheath 16 is removed to expose a portion of conductive shield 14. To effect removal of a portion of conductive shield 14, while maintaining shield continuity through edge fold 15, conductive shield 14 is nicked at each end of the exposed section. This nicking operation can be effected advantageously with scissors, tin snips and the like or any other reasonably sharp instrument. Once the nicks are made, conductive shield 14 is peeled around and away from the cable core as shown in FIG. 3.

Figure 4:
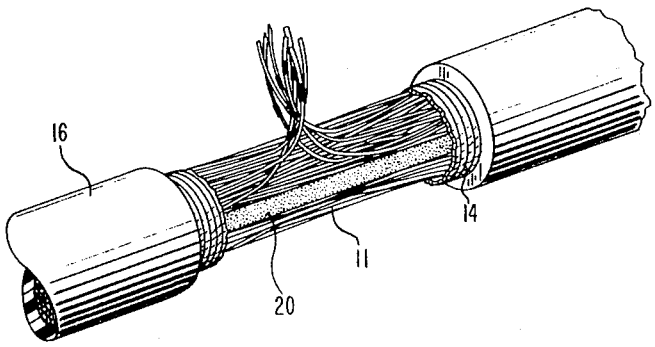
FIG. 4 illustrates the cable at the point of entry to the cable core after removal of a portion of the conductive shield.

After conductive shield 14 is peeled back to edge fold 15, it is broken or cut away along scored line 21, as shown in FIG. 4. The breaking of conductive shield 14 can be effected advantageously by flexing it several times about scored line 21. Cutting of conductive shield 14 along scored line 21 by scissors or the like has also been found to be an effective way to remove the undesired portion of conductive shield 14. In some applications it may be more desirable to remove the selected portion of conductive shield 14 in several small pieces instead of one large piece.

In all cases it is to be understood that the above-described embodiment is illustrative of but a small number of many possible specific embodiments which can represent applications of the principles of the invention. Thus, numerous and various other embodiments can be devised readily in accordance with these principles by those skilled in the art without deparing from the spirit and scope of the invention.

I claim:

1. A method for making an electrical cable comprising the steps of binding a plurality of insulated conductors in close proximity to one another to form a cable core;

surrounding said cable core with a layer of insulative material;

forming an electrically conductive layer about said layer of insulative material; and encasing said electrically conductive layer and all other elements internal thereto in an insulative sheath CHARACTERIZED IN THAT the forming step further includes the steps of corrugating said electrically conductive layer to form a plurality of juxtaposed corrugations;

folding one edge of said conductive layer to form at least one generally flattened S-like fold wherein oppositely directed bends of said fold are in contact with one another throughout their extent for providing electrical continuity along the length of said conductive layer upon entry through said conductive layer to gain access to said cable core;

coating at least exposed surfaces of said edge fold with an insulative layer; and rolling said conductive layer with said edge fold about said cable core such that the coated edge fold surfaces are adjacent and facing the core and the other edge of the conductive layer laps over said one edge.

2. The method in accordance with claim 1 wherein before said rolling step said method further includes the step of imparting to said conductive layer a scored line adjacent said edge fold, said scored line extending linearly along the length of said cable.

3. The method in accordance with claim 1 wherein before said rolling step said method further includes the step of imparting to said conductive layer a series of perforations adjacent said edge fold, said series of perforations extending linearly along the length of said cable.

4. The method in accordance with claim 1 wherein said coating step further comprises the step of exposing said edge fold to a fluidizing bed so as to insulate said edge fold.

5. A method for making an electrical cable comprising the steps of binding a plurality of insulated conductors in close proximity to one another to form a cable core;

surrounding said cable core with a layer of insulative material;

forming an electrically conductive layer about said layer of insulative material; and encasing said electrically conductive layer and all other elements internal thereto in an insulative sheath CHARACTERIZED IN THAT the forming step further includes the steps of corrugating said electrically conductive layer to form a plurality of juxtaposed corrugations;

rolling one edge of said conductive layer to form a plurality of concentric rolls wherein each of said rolls is in contact with another such roll throughout its extent for providing electrical continuity along the length of said conductive layer upon entry through said conductive layer to gain access to said cable core;

coating at least exposed surfaces of said rolled edge with an insulative layer; and rolling said conductive layer with said rolled edge about said cable such that the coated edge rolled surfaces are adjacent and facing the core and the other edge of the conductive layer laps over said one edge.

6. A method for making an electrical cable comprising the steps of binding a plurality of insulated conductors in close proximity to one another to form a cable core;

surrounding said cable core with a layer of insulative material;

forming an electrically conductive layer about said layer of insulative material, said forming step further including the steps of corrugating said electrically conductive layer to form a plurality of juxtaposed corrugations;

folding one edge of said conductive layer to form at least one generally flattened S-like fold;

coating at least exposed surfaces of said edge fold with an insulative layer;

imparting to said conductive layer a scored line adjacent said edge fold, said scored line extending linearly along the length of said cable; and rolling said conductive layer with said edge fold about said cable core such that said coated edge fold surfaces are adjacent and facing said cable core and the other edge of the conductive layer laps over said edge fold, the shaping and positioning of said edge fold, along with said scored line, facilitating access to said cable core through said conductive layer while maintaining electrical continuity in said conductive layer along said edge fold; and encasing said electrically conductive layer and all other elements internal thereto in an insulative sheath.

7. A method for making an electrical cable comprising the steps of binding a plurality of insulated conductors in close proximity to one another to form a cable core;

surrounding said cable core with a layer of insulative material;

forming an electrically conductive layer about said layer of insulative material, said forming step further including the steps of corrugating said electrically conductive layer to form a plurality of juxtaposed corrugations;

folding one edge of said conductive layer to form at least one generally flattened S-like fold;

coating at least exposed surfaces of said edge fold with an insulative layer;

imparting to said conductive layer a series of perforations adjacent said edge fold, said series of perforations extending linearly along the length of said cable; and rolling said conductive layer with said edge fold about said cable core such that said coated edge fold surfaces are adjacent and facing said cable core and the other edge of the conductive layer laps over said edge fold, the shaping and positioning of said edge fold, along with said series of perforations, facilitating access to said cable core through said conductive layer while maintaining electrical continuity in said conductive layer along said edge fold; and encasing said electrically conductive layer and all other elements internal thereto in an insulative sheath.

8. A method for making an electrical cable comprising the steps of binding a plurality of insulated conductors in close proximity to one another to form a cable core;

surrounding said cable core with a layer of insulative material;

forming an electrically conductive layer about said layer of insulative material, said forming step further including the steps of corrugating said electrically conductive layer to form a plurality of juxtaposed corrugations;

rolling one edge of said conductive layer to form a plurality of concentric rolls;

coating at least exposed surfaces of said rolled edge with an insulative layer;

imparting to said conductive layer a scored line adjacent said rolled edge, said scored line extending linearly along the length of said cable; and rolling said conductive layer with said rolled edge about said cable core such that said coated rolled edge surfaces are adjacent and facing said cable core and the other edge of the conductive layer laps over said rolled edge, the shaping and positioning of said rolled edge, along with said scored line, facilitating access to said cable core through said conductive layer while maintaining electrical continuity in said conductive layer along said rolled edge; and encasing said electrically conductive layer and all other elements internal thereto in an insulative sheath.

9. A method for making an electrical cable comprising the steps of binding a plurality of insulated conductors in close proximity to one another to form a cable core;

surrounding said cable core with a layer of insulative material;

forming an electrically conductive layer about said layer of insulative material, said forming step further including the steps of corrugating said electrically conductive layer to form a plurality of juxtaposed corrugations;

rolling one edge of said conductive layer to form a plurality of concentric rolls;

coating at least exposed surfaces of said rolled edge with an insulative layer;

imparting to said conductive layer a series of perforations adjacent said rolled edge, said series of perforations extending linearly along the length of said cable; and rolling said conductive layer with said rolled edge about said cable core such that said coated rolled edge surfaces are adjacent and facing said cable core and the other edge of the conductive layer laps over said rolled edge, the shaping and positioning of said rolled edge, along with said series of perforations, facilitating access to said cable core through said conductive layer while maintaining electrical continuity in said conductive layer along said rolled edge; and encasing said electrically conductive layer and all other elements internal thereto in an insulative sheath.

* * * * *